US011338335B1

(12) United States Patent
Maldonado et al.

(10) Patent No.: US 11,338,335 B1
(45) Date of Patent: May 24, 2022

(54) SYSTEM FOR CLEANING AGRICULTURAL BINS

(71) Applicants: Said A. Maldonado, Avenal, CA (US); Maria Guadalupe Resendez, Avenal, CA (US)

(72) Inventors: Said A. Maldonado, Avenal, CA (US); Maria Guadalupe Resendez, Avenal, CA (US)

( * ) Notice: Subject to any disclaimer, the term of this patent is extended or adjusted under 35 U.S.C. 154(b) by 205 days.

(21) Appl. No.: 16/780,960

(22) Filed: Feb. 4, 2020

(51) Int. Cl.

| | |
|---|---|
| ***B08B 9/30*** | (2006.01) |
| ***B08B 9/42*** | (2006.01) |
| ***B08B 9/08*** | (2006.01) |
| ***B08B 9/34*** | (2006.01) |
| ***B08B 9/20*** | (2006.01) |

(52) U.S. Cl.
CPC ..... *B08B 9/42* (2013.01); *B08B 9/0861* (2013.01); *B08B 9/205* (2013.01); *B08B 9/30* (2013.01); *B08B 9/34* (2013.01)

(58) Field of Classification Search
CPC ..... B08B 9/42; B08B 9/0861; B08B 9/205; B08B 9/30; B08B 9/34; B65F 7/005; B65F 2003/023
See application file for complete search history.

(56) References Cited

U.S. PATENT DOCUMENTS 5,993,739 A * 11/1999 Lyon ..... B60S 3/04 134/108
6,974,017 B2 12/2005 Oseguera
8,273,186 B2 * 9/2012 Rubenzer ..... B08B 1/02 134/122 R
2004/0159336 A1 * 8/2004 Feistmanti ..... B60S 3/00 134/18
2012/0048301 A1 * 3/2012 Beard ..... B08B 9/28 134/10
2013/0019906 A1 * 1/2013 Parlow, II ..... B08B 3/022 134/72
2014/0060585 A1 * 3/2014 Van Den Nieuwelaar ..... A01K 45/00 134/22.1
2017/0036248 A1 * 2/2017 Gross ..... B08B 5/026
2018/0229280 A1 * 8/2018 Reed ..... B08B 9/30

FOREIGN PATENT DOCUMENTS

EP 1433677 A2 * 6/2004 ..... B60S 3/00

* cited by examiner

*Primary Examiner* — Joseph L. Perrin
*Assistant Examiner* — Irina Graf
(74) *Attorney, Agent, or Firm* — Sanchelima & Associates, P.A.; Christian Sanchelima; Jesus Sanchelima

(57) ABSTRACT

A system for cleaning agricultural bins including a conveyer belt assembly and a water jet assembly is disclosed herein. The conveyer belt includes bin rollers configured to automatically transport bins mounted thereon. The bin rollers roll bins along the conveyer assembly to the flat surface of the second end of the first section and then the bins are transferred to the cleaner section via the grapple mechanism and the pivot point to the cleaner section arranged below the bin rollers within the first section. The water jet sprays then thoroughly clean the interior and exterior of the bins. The system for cleaning agricultural bins allows a user to clean an agricultural bin in less than one minute. Furthermore, the amount of time using a water hose is reduced thereby saving money and conserving water for a user.

9 Claims, 3 Drawing Sheets

SYSTEM FOR CLEANING AGRICULTURAL BINS

BACKGROUND OF THE INVENTION

1. Field of the Invention

The present invention relates to system for cleaning bins and, more particularly, to a system for cleaning agricultural bins that aids a user in cleaning big agricultural bins in under one minute.

2. Description of the Related Art

Several designs for a system for cleaning agricultural bins have been designed in the past. None of them, however, include an agricultural bin cleaning system comprising a bin transporting conveyor and water jet sprayer system wherein the bins are loaded onto the conveyor which transports the bins through the water spray jets for cleaning the interior of the bins. It is known that individuals who work in farms often regularly use large agricultural bins. It is also known that these bins must often be cleaned regular as to not contaminate the food held within the bins. The cleaning process for these bins is often done using a water hose and having an individual hose down the dirty bin. This process is often time consuming taking up to ten minutes to clean a single bin. Therefore, there is a need for a system for cleaning agricultural bins that allows a user to clean a bin effortlessly and efficiently.

Applicant believes that a related reference corresponds to (published application) U.S. Pat. No. 6,974,017 for a method and apparatus for moving and packing freshly harvested agricultural products in such a way as to minimize the damage to agricultural products from bruising and breakage resulting from falling into storage bins. This invention uses a hydraulic-driven conveyor belt to move smaller transport containers which are physically closer to the actual point where the agricultural products are discharged into the waiting transport containers. However, it differs from the present invention because the U.S. Pat. No. 6,974,017 reference fails to provide a method to effortlessly and efficiently clean an agricultural bin. The present invention addresses this issue by providing a conveyer belt assembly that feeds agricultural bins into a water jet assembly to clean the bins. The present invention is capable of cleaning a large agricultural bin in under one minute.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a system for cleaning agricultural bins that allow a user to effortlessly clean an agricultural bin in under one minute.

It is another object of this invention to provide a system for cleaning agricultural bins that reduces the workload of cleaning agricultural bins thereby saving money.

It is still another object of the present invention to provide a system for cleaning agricultural bins that reduces the time spent using a water hose thereby saving money and conserving water for a user.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
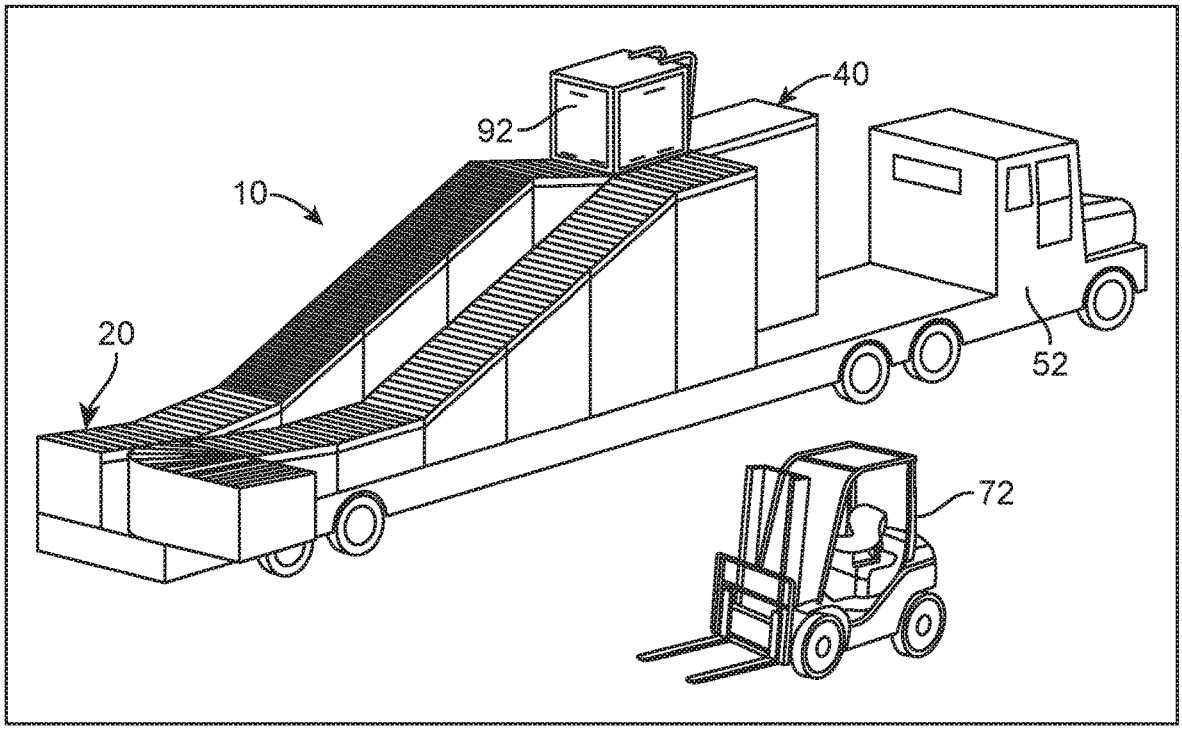
FIG. 1 represents an isometric view of a system for cleaning agricultural bins 10 in accordance to an embodiment of the present invention.
Figure 2:
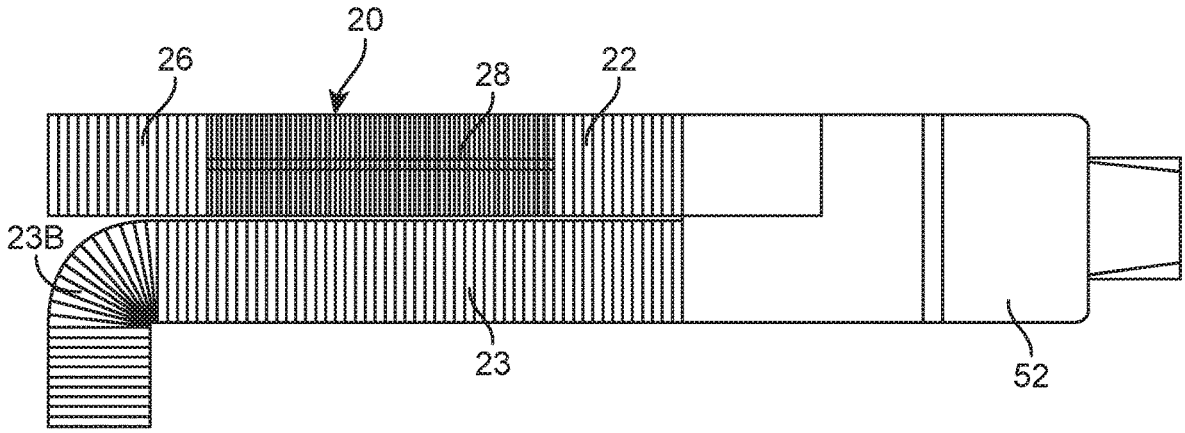
FIG. 2 shows an isometric top view of a system for cleaning agricultural bins 10 in accordance to an embodiment.
Figure 3:
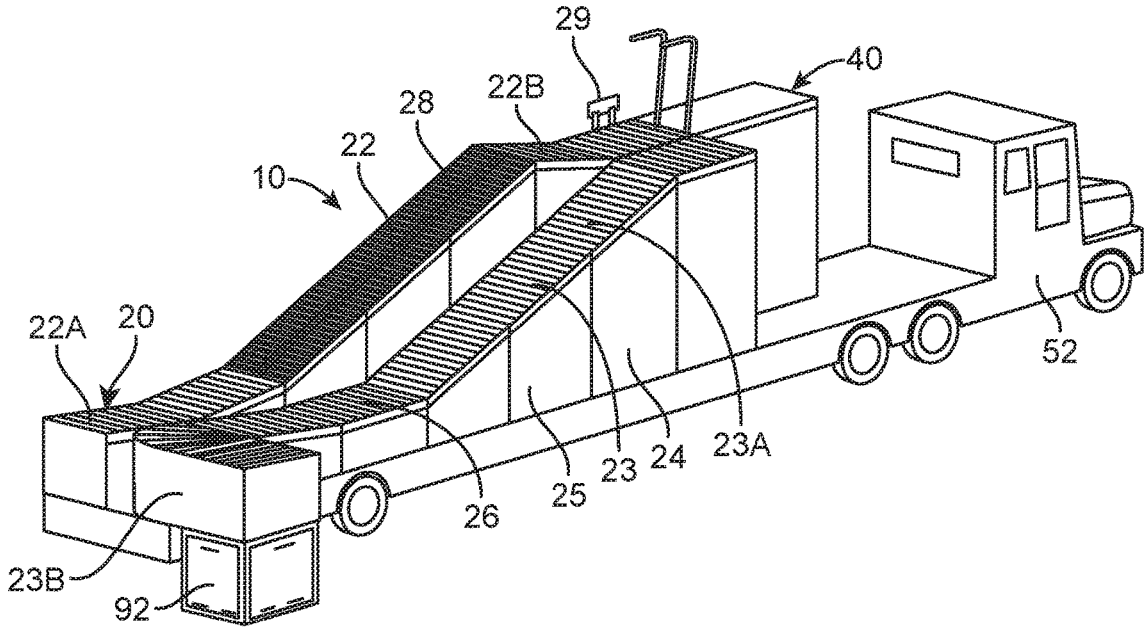
FIG. 3 illustrates an isometric side view of a system for cleaning agricultural bins 10 in accordance to an embodiment of the present invention.
Figure 4:
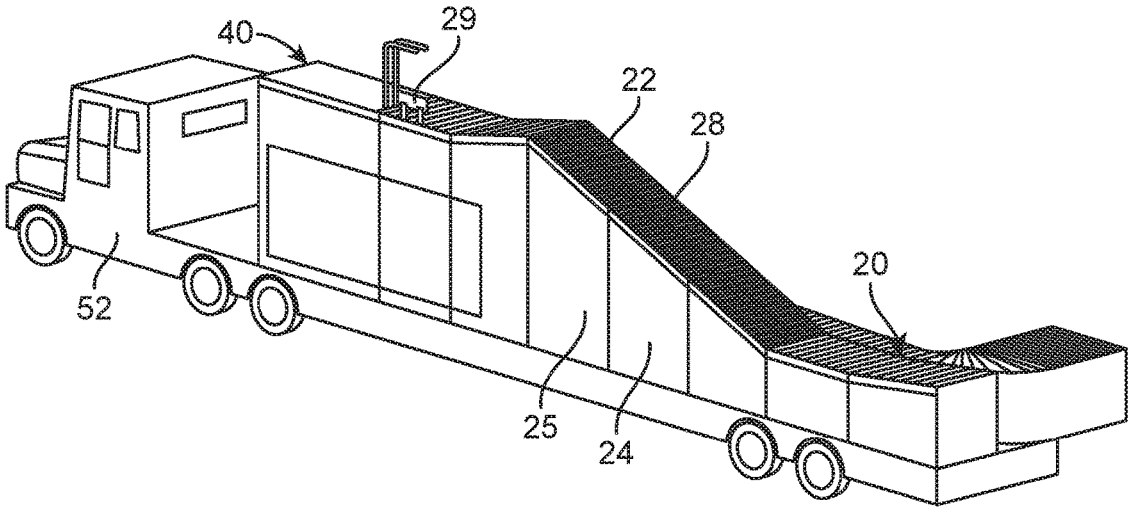
FIG. 4 is a representation of another isometric side view of a system for cleaning agricultural bins 10 in accordance to an embodiment of the present invention.
Figure 5:
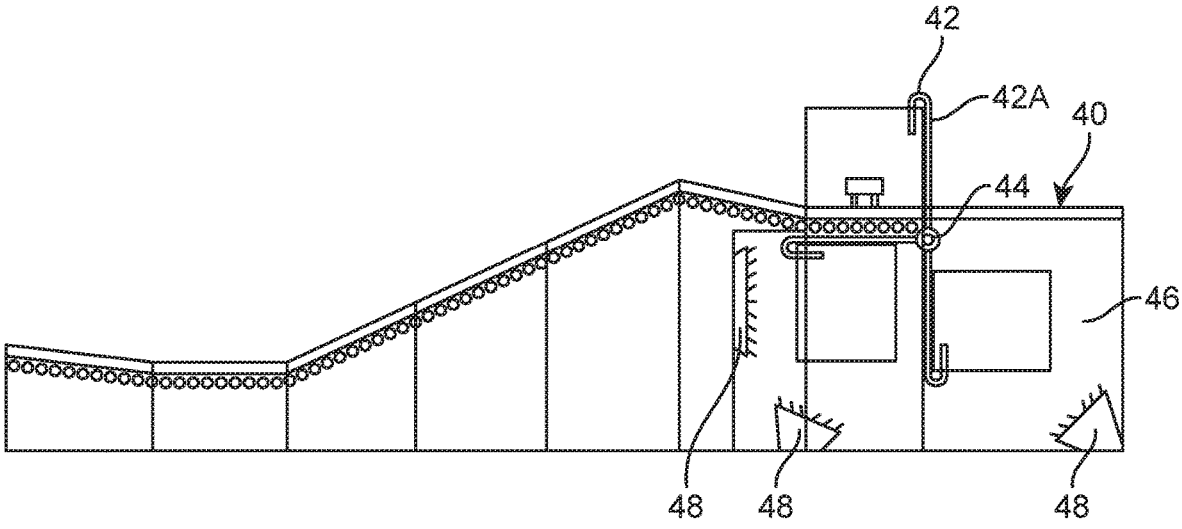
FIG. 5 is a representation of a side interior view of a system for cleaning agricultural bins 10 in accordance to an embodiment of the present invention.

Referring now to the drawings, where the present invention is generally referred to with numeral 10, it can be observed a system for cleaning agricultural bins 10 that basically includes a conveyer belt assembly 20 and a water jet assembly 40, a truck 52, a forklift 72, and an agricultural bin 92.

Conveyer belt assembly 20 includes a first section 22 and a second section 23. In one embodiment first section 22 and second section 23 are sections of a conveyer belt. Furthermore, first section 22 and second section 23 may be of a suitable size to hold agricultural bin 92 thereon. Additionally, first section 22 and second section 23 may be made of any suitable material such as but not limited to metal and carbon fiber. First section 22 and second section 23 may represent a configuration of a conveyer belt. It should be understood, that any configuration of a conveyer belt may be used for first section 22 and second section 23. In one embodiment, first section 22 and second section 23 further include a rectangular base 24 and sidewalls 25. Rectangular base 24 and sidewalls 25 represents the base floor and sidewalls of first section 22 and second section 23. It should be understood that rectangular base 24 and sidewalls 25 may be made of the same material as first section 22 and second section 23. In one embodiment, first section 22 and second section 23 may be placed on a ground floor for operation and use. In another embodiment, first section 22 and second section 23 may be mounted on top of a truck 52 for operation and use. Truck 52 allows for the system for cleaning agricultural bins 10 to be easily portable between locations. This may be helpful in situations wherein a famer has various agricultural bins in need of cleaning. The fanner may transport the present invention 10 to any desired location. Additionally, first section 22 and second section 23 may include bin rollers 26 mounted in a horizontal position on a top end of first section 22 and second section 23. Bin rollers 26 may be any suitable bin rollers that are found on conveyer belts. They may be cylindrical in shape and be made of a material to easily allow any object to easily be transported thereon. In one embodiment, first section 22 and second section 23 may be mounted adjacently next to each other. Though, it should be understood, other embodiments may include different sections mounted in other configurations. First section 22 may include a first end having a first decline 22A. First decline 22A aids an object such as agricultural bin 92 to easily be received and rolled down first section 22. First section 22 further includes an incline positioned after first decline 22A. In one embodiment, this first incline includes rubber grip rollers 28 mounted on a horizontal position thereon. Rubber grip rollers 28 allows agricultural bin 92 to be securely gripped onto first section 22. Additionally, rubber grip rollers 28 provide the necessary grip needed for agricultural bin to be raised on the incline. First section 22 further includes a second decline 22B located after the incline having rubber grip rollers 28 thereon. Second decline 22B allows agricultural bin 92 to be eased into a second end of first section 22. In one embodiment, the second end of first section 22 is a flat surface. Agricultural bin 92 then rests on the flat surface and is then ready to be engaged by water jet assembly 40. Once agricultural bin 92 has been washed thoroughly by water jet assembly 40 it is then transported to second section 23. Second section 23 then may include a second section decline 23A. Second section decline 23A may be a steeper decline than the declines of first section 22. Additionally, second section decline 23A allows agricultural bin 92 to easily travel down second section 23 to be ready for pickup. Second section decline 23A then leads into a curved portion 23B of second section 23. In one embodiment, curved portion 23B is a curved section of the conveyer belt that is second section 23. Curved portion 23B then leads into an exit where a user may remove agricultural bin 92 from conveyer assembly 20. Conveyer assembly 20 provides a user the needed configuration for transporting an agricultural bin 92 for cleaning.

Water jet assembly 40 includes a grapple mechanism 42 located at the second end of first section 22. In one embodiment, grapple mechanism 42 includes two grapple bars 42A mounted on a pivot point 44. Grapple bars 42A may be elongated rods having a grappling member located on a top end. It should be understood that the grapple members used may be any suitable grapple members that can latch onto agricultural bin 92. The tip of grapple bars 42A then clamp down on a side of agricultural bin 92 to create a secure attachment. Furthermore, pivot point 44 may be a circular member having grappling bars 42A attached thereon. In one embodiment, pivot point 44 may be attached to a motor. The motor can then actuate grapple mechanism 42 to then rotate grapple mechanism 42 to then latch onto agricultural bin 92. In one embodiment, this motor may be an existing motor on truck 52 or it may be an external motor used to power water jet assembly 40. Grapple mechanism 42 then rotates and transports agricultural bin 92 into a cleaner section 46 located within first section 22 of conveyer assembly 20. In one embodiment, cleaner section 46 is a rectangular housing extending a predetermined amount therein first section 22. Cleaner section 46 further includes water jets 48 that are mounted therein. Water jets 48 may be of a high-pressure variety suitable to thoroughly clean out agricultural bin 92. It should be understood, that any suitable water jet may be used for water jet 48. Additionally, the water being supplied to water jets 48 may be an external water supply which a user then mounts thereon to water jets 48. Additionally, water jets 48 may be located on a bottom end of cleaner section 46. Water jets 48 may additionally mounted along a sidewall or sidewalls of cleaner section 46. It should be understood, that any configuration of water jets 48 may be mounted within cleaner section 46 in order to have the optimal clean results for agricultural bin 92. Additionally, water jets 48 may be modified as needed. A user may modify such features as the spray pattern, intensity, and location to best suit the cleaning of the agricultural bin. Water jets 48 may be located on all sides of the internal component if need be. Additionally, the interior portion of the conveyer assembly 20 may be closed of so the water used to clean the bins may be recycled for further use. In one embodiment, a user utilizes a forklift 72 to then mount agricultural bin thereon conveyer assembly 20. Agricultural bin 92 is then transported to water jet assembly 40 where it is thoroughly cleaned out and sanitized. Additionally, the agricultural bin 92 is then returned to the conveyer assembly 20 where it is transported for removal for a user. System for cleaning agricultural bin 10 provides a user with the most efficient method and system for cleaning agricultural bin 92.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for cleaning agricultural bins, comprising:

a. a conveyer assembly, including a first section and a second section, wherein said first section has a rectangular base and sidewalls thereon, wherein said first section and said second section include bin rollers mounted in a horizontal position along a top of said first section and said second section, said first section and said second section being mounted adjacently, wherein said first section includes a first end having a first decline, said first section including an incline positioned after said first end, wherein said incline includes rubber grip rollers mounted in a horizontal position along a top of said incline, wherein said rubber grip rollers are configured to help move said agricultural bin along said incline, wherein said first section further includes a second decline placed after said incline, wherein said second decline leads into a second end of said first section, wherein said second end is a flat surface, said second section having a second section decline wherein said agricultural bin travels along said second section decline into a curved portion, wherein said curved portion then leads to an exit, wherein a user removes said agricultural bin from said exit, wherein a first end of said second section is a flat surface adjacent to said flat surface of said second end of said first section; and b. a water jet assembly, including a grapple mechanism mounted to said second end of said first section, wherein said grapple mechanism includes two grapple bars mounted on a pivot point located on said second end of said first section, wherein said tips of said grapple bars then clamp down on a side of said agricultural bin, wherein said grapple bars then rotate said agricultural bin into a cleaner section arranged within said first section, wherein said cleaner section is a rectangular housing extending a predetermined amount within said first section, wherein said cleaner section includes water jets mounted therein, wherein said water jets are placed on a bottom of said cleaner section.

2. The system for cleaning agricultural bins of claim 1 wherein said conveyer assembly and said water jet assembly are mounted onto a truck bed.

3. The system for cleaning agricultural bins of claim 2 wherein a portion of said exit extends out of said truck bed.

4. The system for cleaning agricultural bins of claim 1 wherein said water jets are mounted along sidewalls of said cleaner section.

5. The system for cleaning agricultural bins of claim 1 wherein said grapple bars attach to an upper edge of said agricultural bin.

6. The system for cleaning agricultural bins of claim 1 wherein said water jets are high pressure water jets.

7. The system for cleaning agricultural bins of claim 1 wherein said water jets further comprise water jets that are mounted on a sidewall of said cleaner section.

8. The system for cleaning agricultural bins of claim 1 wherein said user controls a forklift to mount said agricultural bin thereon said first end.

9. The system for cleaning agricultural bins of claim 1 wherein said conveyer assembly and said water jet assembly are mounted on a truck.

* * * * *